US010405587B2

(12) United States Patent
Cortese et al.

(10) Patent No.: US 10,405,587 B2
(45) **Date of Patent: *Sep. 10, 2019**

(54) GARMENT FOR SELECTIVELY SUPPORTING SHIELDS FOR EXPRESSING MILK

(71) Applicant: TARGET BRANDS, INC., Minneapolis, MN (US)

(72) Inventors: Daniele M. Cortese, Minneapolis, MN (US); Emily Weich, Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 363 days.

This patent is subject to a terminal disclaimer.

(21) Appl. No.: 15/221,330

(22) Filed: Jul. 27, 2016

(65) Prior Publication Data

US 2016/0331045 A1 Nov. 17, 2016

Related U.S. Application Data

(63) Continuation of application No. 13/843,058, filed on Mar. 15, 2013, now Pat. No. 9,402,425.

(51) Int. Cl.
*A41C 3/04* (2006.01)
*A41D 1/215* (2018.01)

(52) U.S. Cl.
CPC ..... *A41C 3/04* (2013.01); *A41D 1/215* (2018.01)

(58) Field of Classification Search
CPC .... A41C 3/04; A41C 3/08; A41C 3/10; A41C 3/00; A41D 1/205; A41D 1/20; A41D 1/22; A41D 27/04
See application file for complete search history.

(56) References Cited

U.S. PATENT DOCUMENTS 1,361,155 A 12/1920 Jackson
1,990,322 A 2/1935 Goldberg
(Continued)

FOREIGN PATENT DOCUMENTS

WO 2009081400 A2 7/2009
WO 2009137223 A2 11/2009

OTHER PUBLICATIONS

"LLLI Patented Hands-Free Pumping & Nursing Bra", publicly offered for sale by La Leche League International at www.llli.com at least as early as Dec. 2011 (1 page).
(Continued)

*Primary Examiner* — Alissa J Tompkins
*Assistant Examiner* — Brieanna Szafran
(74) *Attorney, Agent, or Firm* — JoAnn M. Seaton; Griffiths & Seaton PLLC

(57) ABSTRACT

A nursing garment includes an interior front layer, an intermediate front layer, and an exterior front layer. The interior front layer includes soft cups for supporting breasts of the wearer and each defining an opening through the interior front layer providing access to a different one of the breasts of the wearer. The intermediate front layer includes two padded cups, is positioned immediately adjacent the interior front layer, and defines an intermediate front layer neckline edge and intermediate front layer underarm edges. The two padded cups overlie the soft cups such that each of the two padded cups covers a different one of the openings of the interior front layer. The exterior front layer extends over the intermediate front layer substantially covering the intermediate front layer and defines exterior front layer underarm edges each sewn to a different one of the intermediate front layer underarm edges.

20 Claims, 12 Drawing Sheets

(56) References Cited

U.S. PATENT DOCUMENTS

| | | | | |
|---|---|---|---|---|
| 2,501,860 | A | 3/1950 | Becker | |
| 2,679,048 | A | 5/1954 | Alberts | |
| 3,175,559 | A | 3/1965 | Kane | |
| 4,390,024 | A | 6/1983 | Williams | |
| 4,564,015 | A | 1/1986 | Friedman | |
| 4,648,404 | A | 3/1987 | Clark | |
| 5,514,166 | A | 5/1996 | Silver et al. | |
| 5,575,768 | A | 11/1996 | Lockridge et al. | |
| 5,611,086 | A | 3/1997 | Eggen | |
| 6,004,186 | A | 12/1999 | Penny | |
| 6,213,840 | B1 | 4/2001 | Han | |
| 6,227,936 | B1 | 5/2001 | Mendoza | |
| 6,247,996 | B1 | 6/2001 | Fields | |
| 6,361,398 | B1 * | 3/2002 | Knapp | A41C 3/04 450/36 |
| 6,786,798 | B1 | 9/2004 | Gendel | |
| 6,821,185 | B1 | 11/2004 | Francis | |
| 6,839,908 | B2 | 1/2005 | Schneider et al. | |
| 6,855,029 | B2 | 2/2005 | Rothman | |
| D505,243 | S | 5/2005 | Thunstedt | |
| 6,974,361 | B2 | 12/2005 | Cravaack et al. | |
| 6,983,489 | B2 | 1/2006 | Caprio | |
| 7,077,720 | B2 | 7/2006 | Schneider et al. | |
| 7,081,034 | B1 | 7/2006 | Zoellner | |
| 7,094,217 | B2 | 8/2006 | Fialkoff | |
| 7,448,090 | B2 | 11/2008 | Lucock | |
| 7,878,880 | B2 | 2/2011 | Hendrickson | |
| 7,878,881 | B2 | 2/2011 | Hendrickson | |
| 7,946,904 | B1 | 5/2011 | Ciullo | |
| 7,950,980 | B2 | 5/2011 | Solberg et al. | |
| D644,003 | S | 8/2011 | Hendrickson | |
| 8,057,452 | B2 | 11/2011 | Fialkoff | |
| 8,137,153 | B2 | 3/2012 | Bell | |
| 8,192,247 | B2 | 6/2012 | Abbaszadeh | |
| 8,226,452 | B2 | 7/2012 | Hendrickson | |
| 8,307,463 | B2 | 11/2012 | Ritchie | |
| 8,323,070 | B2 | 12/2012 | Abbaszadeh | |
| 8,469,769 | B2 | 6/2013 | Hendrickson | |
| 8,469,770 | B2 | 6/2013 | Alva | |
| 9,113,660 | B2 | 8/2015 | Op't Hof | |
| 2003/0027491 | A1 | 2/2003 | Cravaack et al. | |
| 2004/0038621 | A1 | 2/2004 | Vera | |
| 2004/0143885 | A1 | 7/2004 | Rothman | |
| 2004/0198176 | A1 | 10/2004 | Dutka et al. | |
| 2005/0026540 | A1 | 2/2005 | Schneider et al. | |
| 2005/0085160 | A1 | 4/2005 | Johnstone | |
| 2007/0074330 | A1 | 4/2007 | Azaronak | |
| 2007/0161330 | A1 | 7/2007 | Whitehead et al. | |
| 2007/0271675 | A1 | 11/2007 | Eraca | |
| 2008/0022434 | A1 | 1/2008 | Adelman | |
| 2008/0229474 | A1 | 9/2008 | Fons et al. | |
| 2009/0036022 | A1 | 2/2009 | Tolliver | |
| 2009/0265831 | A1 | 10/2009 | Hendrickson | |
| 2009/0282603 | A1 | 11/2009 | Kumar | |
| 2009/0286452 | A1 | 11/2009 | Grayson | |
| 2010/0031418 | A1 | 2/2010 | Op't Hof | |
| 2010/0058512 | A1 | 3/2010 | Rothman | |
| 2010/0068971 | A1 * | 3/2010 | Hendrickson | A41C 3/04 450/31 |
| 2010/0068972 | A1 * | 3/2010 | Hendrickson | A41C 3/04 450/36 |
| 2011/0219513 | A1 | 9/2011 | Hendrickson | |
| 2011/0237156 | A1 | 9/2011 | Boonen et al. | |
| 2011/0314587 | A1 * | 12/2011 | Ritchie | A41C 3/04 2/104 |
| 2013/0232661 | A1 | 9/2013 | Huntley | |
| 2015/0143605 | A1 | 5/2015 | Cobb | |
| 2016/0007659 | A1 | 1/2016 | Blacker | |

OTHER PUBLICATIONS

"Milkalicious Double Cream Nursing Tank", printed from www.milkalicious.com/Milkalicious_Double_Cream_Nursing_Tank_p/milk-tank.htm available at least as early as Jun. 9, 2012 and additional product pictures (3 pages).

* cited by examiner

GARMENT FOR SELECTIVELY SUPPORTING SHIELDS FOR EXPRESSING MILK

CROSS-REFERENCE TO RELATED APPLICATION

This application is a continuation of and claims priority to U.S. patent application Ser. No. 13/843,058, filed Mar. 15, 2013, which is incorporated herein by reference.

BACKGROUND OF THE INVENTION

The benefits of nourishing newborn infants by breastfeeding have long been established. Nursing mothers today are increasingly busy and for various reasons often wish to express breast milk to store for times when she is unable or unavailable to directly breast feed her infant or for modesty, convenience, or other reasons prefers not to directly breast feed her infant. A woman typically expresses breast milk using an electric or manual pumping device in connection with a funnel or shield that is held tightly over the woman's breast. The pumping device creates suction inducing milk flow and directing the flow of milk through the shield and to a storage container coupled to the pumping device.

To save time, women often express milk from both breasts simultaneously, which generally requires the woman to hold the shields using both hands against her breasts, leaving her unable to enjoy other activities requiring use of her hands. The process of expressing milk can be time consuming, and consequently, there is a need for garments that assist a woman in holding the shields tightly against her breasts during milk expression while freeing her hands for other activities. Existing garments for this purpose largely are configured to be worn only during periods when milk is being expressed, thereby, requiring a garment change before and after expressing milk, which increases the burden on the woman expressing milk. Accordingly, there continues to be a need for garments that both assist a woman in expressing milk and provide the support and/or style desired by the woman during periods between milk expressing sessions.

SUMMARY

One aspect of the present invention relates to a nursing garment configured to be worn by a wearer having breasts. The nursing garment includes an interior front layer, and intermediate front layer, and an exterior front layer. The interior front layer is adapted to be positioned immediately adjacent the wearer during use of the nursing garment and includes soft cups for supporting the breasts of the wearer. Each of the soft cups defines an opening through the interior front layer providing access to a different one of the breasts of the wearer. The intermediate front layer includes two padded cups and is positioned immediately adjacent the interior front layer. The intermediate front layer defines an intermediate front layer neckline edge and intermediate front layer underarm edges extending away from opposing ends of the intermediate front layer neckline edge. The two padded cups of the intermediate front layer overlie the soft cups of the interior front layer such that each of the two padded cups covers a different one of the openings of the interior front layer. The exterior front layer extends over the intermediate front layer opposite the interior front layer and substantially covers the intermediate front layer. The exterior front layer defines exterior front layer underarm edges each sewn to a different one of the intermediate front layer underarm edges. To permit nursing, the intermediate front layer and the exterior front layer collectively fold down away from the interior front layer permitting access to one or more of the breasts of the wearer via one or more of the openings of the interior front layer. Other apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
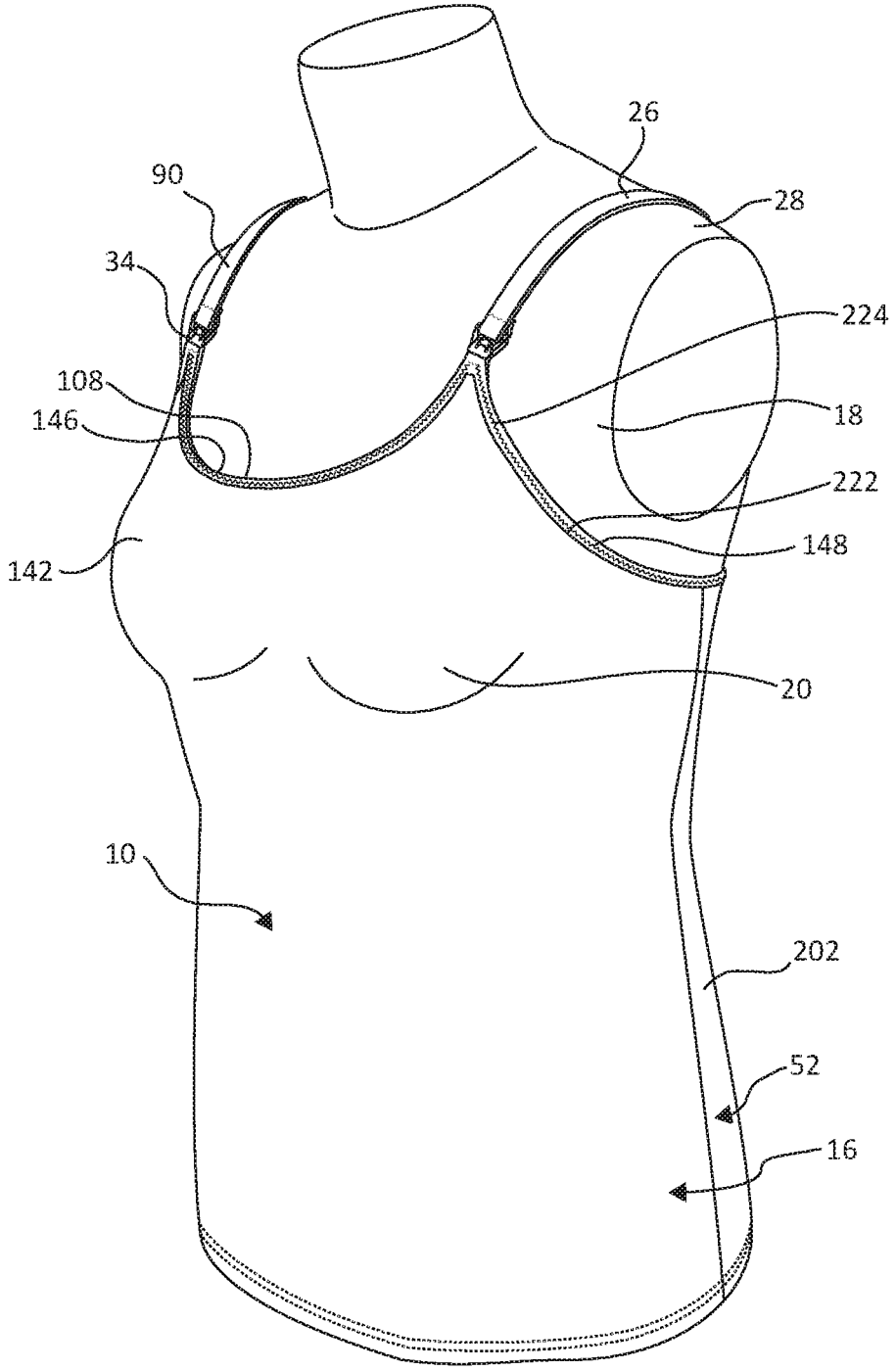
FIG. 1 is a front perspective view illustration of a nursing garment in a normal wear configuration, according to one embodiment of the present invention.
Figure 2:
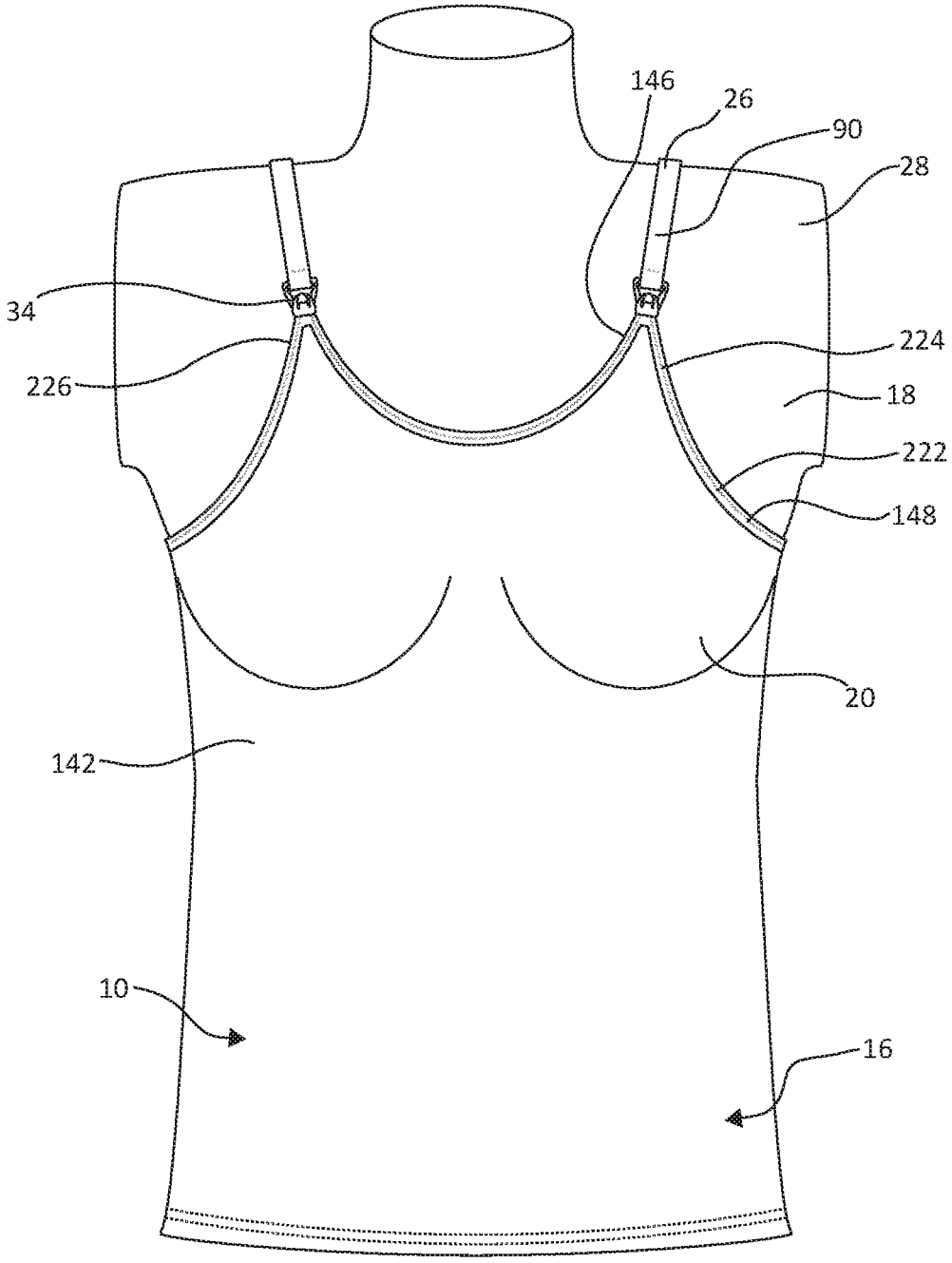
FIG. 2 is a front view illustration of the nursing garment of FIG. 1 in the normal wear configuration, according to one embodiment of the present invention.
Figure 3:
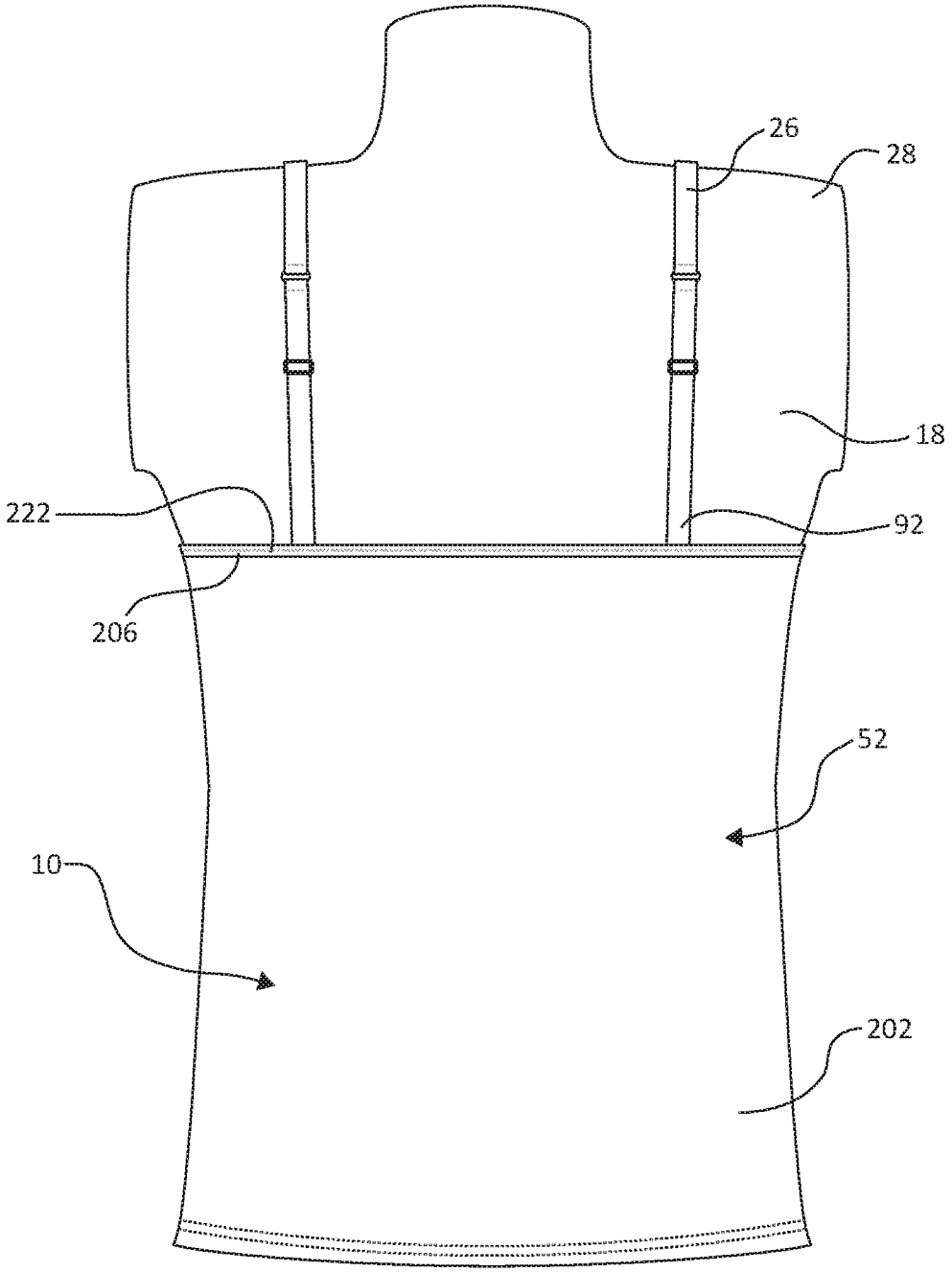
FIG. 3 is a rear view illustration of the nursing garment of FIG. 1 in the normal wear configuration, according to one embodiment of the present invention.
Figure 4:
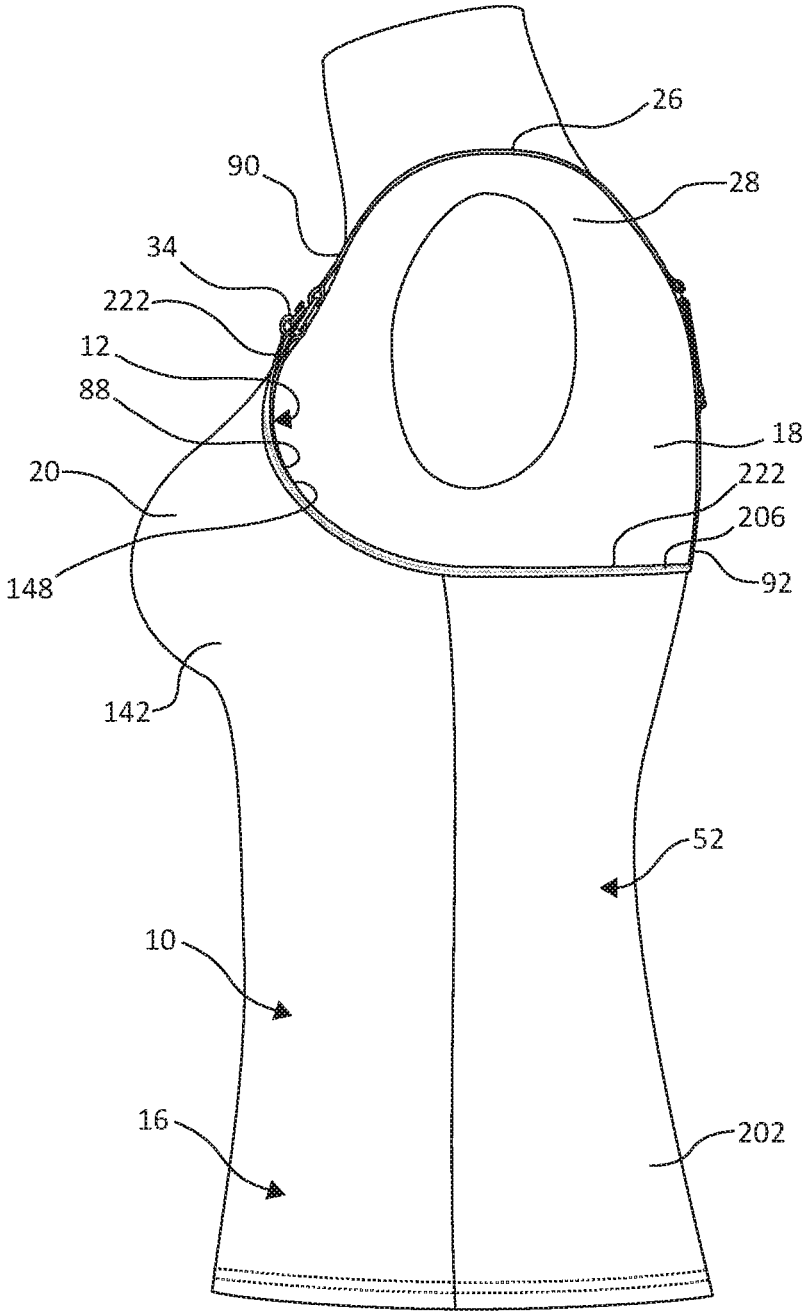
FIG. 4 is a right side view illustration of the nursing garment of FIG. 1 in the normal wear configuration, according to one embodiment of the present invention.

This innovation relates to a garment for wear by a nursing mother to assist in expressing milk in a manner leaving the mother's hands free for use during milk expression, even when simultaneously expressing from both of the mother's breasts. The garment provides breast support and style to the mother such that the garment is suitable for wear by the mother during periods of non-breast feeding or milk expression. By providing a single garment that can be used for normal wear support, for maintaining a pump device shield in proper contact with a breast during milk expression, and/or for direct infant nursing, a mother does not need to change her bra or undergarment to separately allow for each of these activities, saving busy mothers some much needed time.

The present invention, more particularly, uses a three-layer front construction to form the garment as a camisole in one example. A first or interior layer fits immediately adjacent a woman's breasts and includes soft cups in which a substantially planar layer of knit stretches to accommodate the woman's breasts as required for various stages during a nursing schedule (for example, a woman's breasts may be one size following nursing or milk expression, but swell to a larger size just before subsequent nursing or milk expression). A seam line passes down the front of each breast, and a small slit or slightly larger opening (e.g., a circular opening) is formed along the seam line providing access to the breast behind the seam line. A second layer incorporates padded or formed cups that can be folded down away from the breasts during nursing. The formed cups provide the woman with modesty in the form of padded coverage as well as providing additional shape and support to the woman's breasts during periods of normal wear.

Turning to the figures, FIGS. 1-4 illustrate various views of a garment 10 in a normal wear configuration and FIGS. 5-9 illustrate various views of garment 10 in a folded down or nursing configuration. As used throughout this application, the term "nursing" should be given broad meaning including direct nursing to an infant or indirect nursing including milk expression from the breasts 20. Garment 10 generally includes an interior front layer 12, an intermediate front layer 14, and an exterior front layer 16 all extending over a front of a woman's torso, generally indicated at 18. More specifically, interior front layer 12 extends directly over the woman's torso 18 including breasts 20, and interior front layer 12 defines soft cups 22 with openings 24 formed therethrough for providing access to breasts 20 by a pumping apparatus 38 (FIG. 9) or, in one example, a nursing infant (not shown). As used herein "soft cups" refer to portions of interior front layer 12 that is configured to stretch to receive breasts 20, but are not preformed in a convex manner or padded with a cup shape, for example, similar to a shelf bra type of support. In one example, interior front layer 12 substantially covers breasts 20, for example, covers more than 75% of breasts 20, such as more than 85% of the woman's breasts, with a majority of the non-covered portion of breasts 20, if any, being viewable through opening 24.

Straps 26 extend upwardly from interior front layer 12 over shoulders 28 of the wearer during use. Intermediate front layer 14 is layered directly over interior front layer 12 and defines formed, padded cups 30 configured to provide additional definition, coverage, and support to breasts 20. In one example, padded cups are preformed with a convex exterior profiles Exterior front layer 16 defines a smooth and substantially continuous outer appearance to garment 10, for example, as a camisole with exterior front layer 16 extending well below each of interior front layer 12 and intermediate front layer 14.

Top portions of each of intermediate front layer 14 and exterior front layer 16 are selectively coupled to interior front layer 12 and straps 26 via clips 34, as will be further described below. When clips 34 are released, intermediate front layer 14 and exterior front layer 16 fold down from the normal use configuration of FIGS. 1-4 to the nursing configuration of Figures. In one example, only one clip 34 is released such that only one side of each of intermediate front layer 14 and exterior front layer 16 is folded down (not shown). Clips 34 are examples of means for selectively securing a top of each of the intermediate front layer 14 and the exterior front layer 16.

Figure 9:
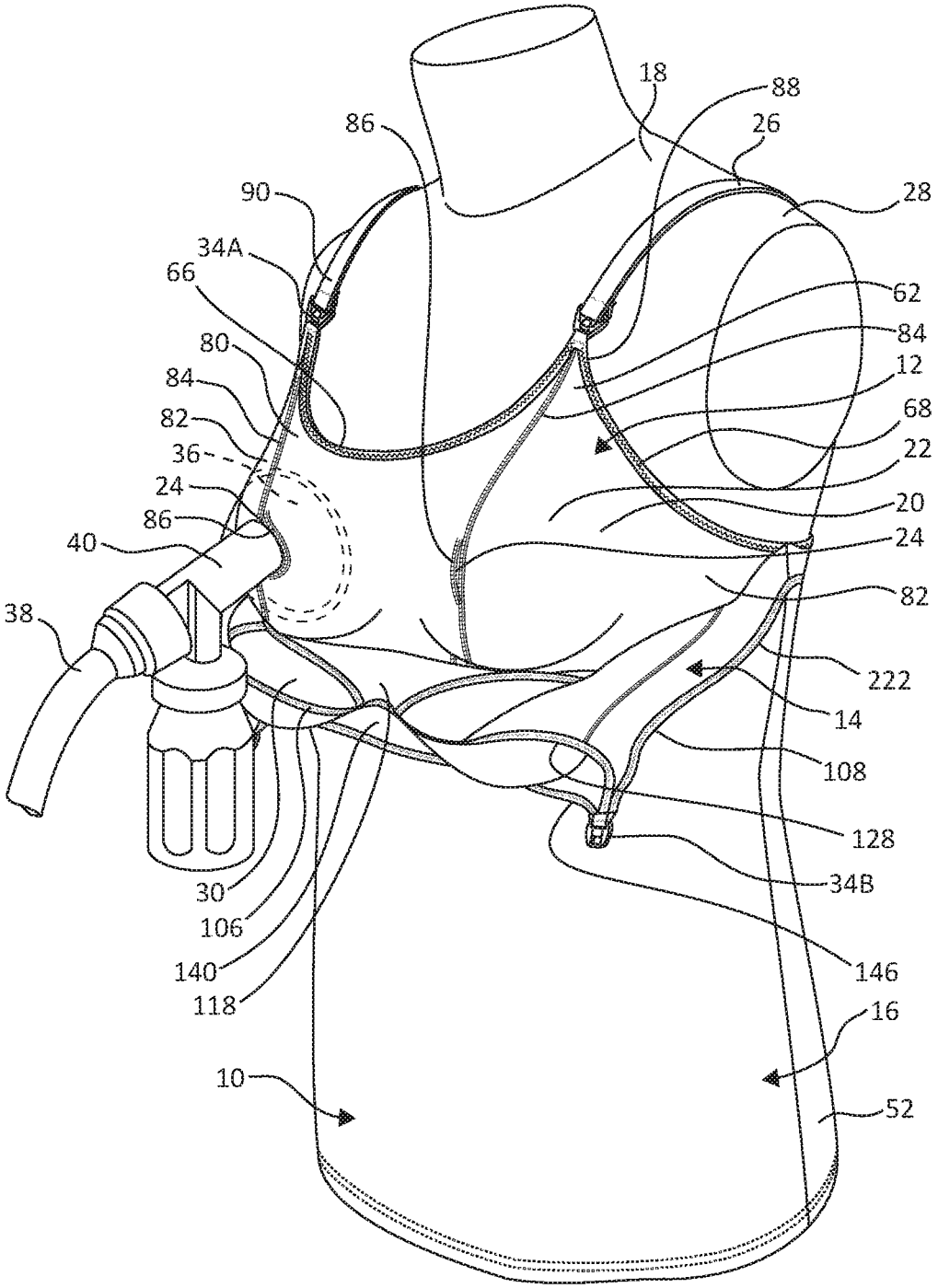
FIG. 9 is the front perspective view illustration of the nursing garment of FIG. 5 during use with a milk expressing apparatus, according to one embodiment of the present invention.

For use while expressing milk, a funnel or shield 36 of pump apparatus 38 is inserted within the interior front layer 12 of garment 10 to fit directly adjacent one of breasts 20 surrounding a nipple (not shown) thereof and such that a milk transfer cylinder 40 extends from shield 36 out opening 24 as illustrated in FIG. 9. Portions of interior front layer 12 adjacent opening 24 extend over shield 36 independently holding shield 36 tightly in place over breast 20 such that a wearer is free to use her hands for other tasks, rather than for holding shield 36 in place during milk expression. With the above description in mind, opening 24 with surrounding portions of interior front layer 12 is one example, of means for maintaining a pumping funnel 36 tightly against the mother's breast and allowing a milk transfer cylinder 40 to extend through the means for supporting.

Figure 10:
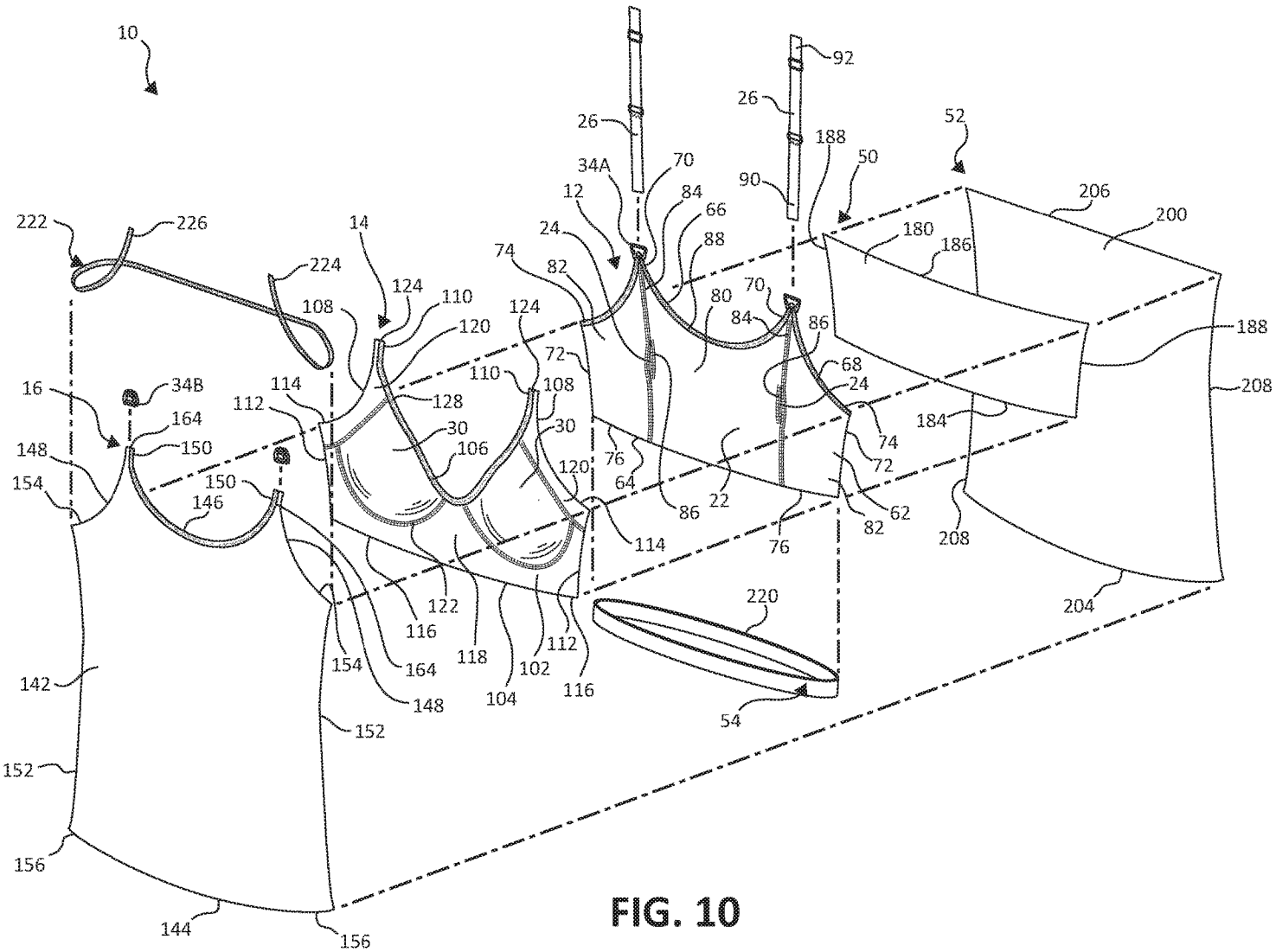
FIG. 10 is an exploded, front perspective view of the nursing garment of FIG. 1, according to one embodiment of the present invention.
Figure 11:
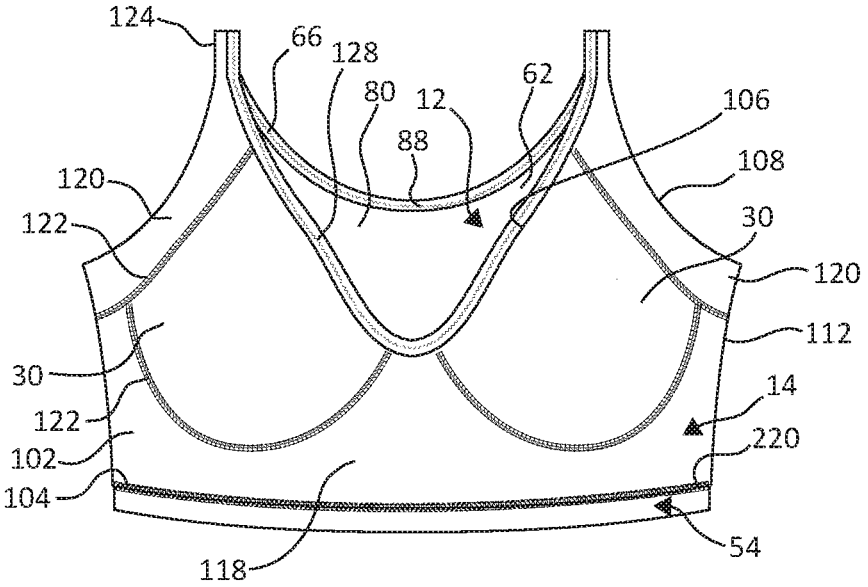
FIG. 11 is a front view illustration of a partially constructed portion of the nursing garment of FIG. 1, according to one embodiment of the present invention.

FIG. 10 illustrates an exploded view of garment 10 according to one embodiment of the present invention. In this embodiment, in addition to interior front layer 12, intermediate front layer 14, and exterior front layer 16, garment 10 includes an interior rear layer 50, an exterior rear layer 52, and an elastic band 54. Examples of each of interior front layer 12, intermediate front layer 14, exterior front layer 16, interior rear layer 50, exterior rear layer 52, and elastic band 54 and an example of assembly thereof is described in detail below.

Continuing to refer to FIG. 10, interior front layer 12 defines an interior surface 60 (FIG. 12), which will be positioned adjacent the woman during use, and an opposite exterior surface 62 facing away from torso 18. Interior front layer 12 extends from a bottom edge 64 upwardly to a neckline edge 66, for example a scoop, V-neck, curved, or other suitably shaped edge 66. Underarm edges 68 extend from opposite ends 70 of neckline edge 66 with downwardly extending curvature away from the other one of underarm edges 68 and are positioned to extend under an arm (not shown) of the woman. Finally, each of two side edges 72 extends substantially vertically between a lower end 74 of a corresponding one of underarm edges 68 opposite neckline edge 66 and one of opposing ends 76 of bottom edge 64. In one example, a length of interior front layer 12 as defined between bottom edge 64 and neckline edge 66 and is sized to cover breasts 20 and a portion of a wearer's chest just above breasts 20 and terminate just below breasts 20, for example, a few inches below breast 20 without extending onto the wearer's stomach area.

Interior front layer 12 is formed of three panels, according to one example, including a center panel 80 and two opposing side panels 82. Center panel 80 is joined to each of the two opposing side panels 82 via an elongated seam 84 extending from bottom edge 64 to neckline edge 66. In one embodiment, center panel 80 is formed of two plies cotton while each of the two opposing side panels 82 is formed of one ply cotton and one top ply stabilizer. The addition of the stabilizer to the two opposing side panels 82 provides additional support to the woman even when intermediate front layer 14 is folded down and only interior layer 12 is positioned to support breasts 20. Center panel 80 is formed without stabilizer allowing interior front layer 12 to stretch and give as needed to accommodate and support breasts 20 as their size fluctuates during the woman's nursing schedule. In view of the above descriptions, center panel 80 is one example of means for allowing the means for interior front layer 12 to adjust with variations in an overall size of the mother's breasts during a nursing cycle, and each of the two opposing side panels 82 is one example of means for providing stabilization to support a mother's breast.

Each opening 24 is formed along one of seam lines 84, for example, as a slit or larger opening, preferably, at a position on soft cup 22 as defined by interior front layer 12 and generally corresponding with an expected location of a woman's nipple (not shown). In one embodiment, seam lines 84 and portions of each of center panel 80 and opposing side panels 82 adjacent openings 24 are substantially inelastic, while, in other embodiments, portions of seam line 84, etc. adjacent to and surrounding openings 24 are elastic to allow additional stretch of openings 24 to accommodate various sizes of pump shields 36 and cylinders 40 and/or to allow pump shields 36 to be moved from outside surface 62 of interior front layer 12 to inside surface 60 thereof through opening 24 to position shield 36 for use. Other variations are also contemplated. In view of the above and below description, interior front layer 12 is one example of means for supporting and substantially covering a mother's breast.

In one example, opening 24 remains substantially spread apart or open at all times, while in another example, opening 24 is initially in the form of a slit or an overlap of material edges that can be spread apart or expanded during use to accept milk transfer cylinder 40 or, in one instance, an entirely of shield 36 can be passed therethrough before being positioned on breast 20. Seam lines 84 are formed in any suitable manner, and in one example, are formed with overlock stitching. In one example, each opposing side panel 82 defines an opening edge 86 immediately adjacent opening 24 having elastic sewn thereto to increase stretch of opening 24 where desired.

Interior front layer 12 includes additional finishes to further complement the aesthetic and functional features of garment 10 and to prevent fraying of edges of interior front layer 12. In one example, interior front layer 12 includes binding 88 of any suitable form, for example, of fold over elastic extending along both neckline edge 66 and underarm edges 68. In one embodiment, clips 34, more particularly, a first clip portion 34A, such as a male portion of clip 34, is coupled to interior front layer 12 at top of interior front layer 12, where neckline edge 66 most closely approaches underarm edge 68.

Intermediate front layer 14 defines an interior surface 100 (FIGS. 5-7 and 9), which will be positioned adjacent interior front layer 12 during use, and an opposite exterior surface 102 facing away from torso 18. Intermediate front layer 14 extends from a bottom edge 104 upwardly to a neckline edge 106, for example, in a V-neck or other suitable shape. In one embodiment, neckline edge 106 of intermediate layer 14 will fall lower on a neckline than neckline edge 66 of interior front layer 12. Intermediate front layer 14 further defines underarm edges 108 extending from opposite ends 110 of neckline edge 106 with downwardly extending curvature away from the other of underarm edges 108 suitable to extend under an arm (not shown) of the woman. Finally, intermediate front layer 14 defines two side edges 112 each extending substantially vertically between a lower end 114 of a corresponding one of underarm edges 108 opposite neckline edge 106 and one of opposing ends 116 of bottom edge 104. In one example, a length of intermediate front layer 14 as defined between bottom edge 104 and a topmost portion of neckline edge 106 and is sized to cover breasts 20 and a portion of a wearer's chest just above breasts 20 and terminate just below, for example a few inches below, breast 20 without extending onto the wearer's stomach area.

Intermediate front layer 14 include three portions according to one embodiment, for example, a cradle 118, padded cups 30, and underarm panels 120. Cradle 118, which, in one example, includes a bridge portion between padded cups 30, extends upwardly from bottom edge 104 across an entire width of intermediate front layer 14 to padded cups 30 and a center portion of neckline 106. Cradle 118 provides support for padded cups 30 and, in one instance, is formed of one ply cotton and one top ply stabilizer to provide cradle 118 with increased stability over a non-stabilized portion of garment 10 helping to hold padded cups 30 in place supporting breasts 20. Padded cups 30 are preformed with curvature to complement and support breasts 20 using any suitable padding as will be apparent to those of skill in the art upon reading this application.

Underarm panel 120 forms an entirety of underarm edge 108 and extends between underarm edge 108 and padded cups 30. In one example, underarm panel 120 borders each of cradle 118 and neckline edge 106 above and below padded cups 30, respectively. Underarm panel 120 additionally extends upwardly as it curves toward neckline edge 106 to form an elongated top flange or top platform 124 for coupling with tab clip 34, more specifically, a second or female portion 34B of clip 34, as will be further described below. In one example, underarm panel 120 is formed of one ply cotton with no stabilizing ply; while in other embodiments, a stabilizing ply may be incorporated in underarm panel 120. Seam line 122, such as overlock seam lines, extend between padded cups 30, cradle 118, and underarm panel 120 coupling padded cups 30, cradle 118, and underarm panel 120 to one another. In view of at least the above description, intermediate front layer 14 is one example of means for providing padded coverage and support to the mother's breast.

Intermediate front layer 14 includes additional finishes to further complement the aesthetic and functional features of garment 10 and to prevent fraying of edges of intermediate front layer 14. In one example, intermediate front layer 14 includes binding 128 of any suitable form, for example, of fold over elastic, extending along neckline edge 106.

Exterior front layer 16 defines an interior surface 140 (FIGS. 5-7 and 9), which will be positioned adjacent intermediate front layer 14 during use, and an opposite exterior surface 142 facing away from torso 18. Exterior front layer 16 extends from a bottom edge 144 upwardly to a neckline edge 146, for example, in a scoop, V-neck or other suitable shape. In one embodiment, neckline edge 146 of exterior front layer 16 will fall higher on a neckline than neckline edge 106 of intermediate front layer 14 to cover intermediate front layer 14 from view while garment 10 is in the normal wear configuration (FIGS. 1-4 and 11). Exterior front layer 16 further defines underarm edges 148 extending from opposite ends 150 of neckline edge 146 with downwardly extending curvature away from the other of underarm edges 148 suitable to extend under an arm (not shown) of the woman. Finally, exterior front layer 16 defines two side edges 152 each extending substantially vertically between a lower end 154 of a corresponding one of underarm edges 148 opposite neckline edge 156 and one of opposing ends 156 of bottom edge 144.

In one example, a length of exterior front layer 16 as defined between bottom edge 144 and neckline edge 146 is considerably longer than the length of either of interior front layer 12 or intermediate front layer 14. For example, exterior front layer 16 is sized to cover substantially an entire torso 18 of a wearer being long enough to provide full stomach coverage and at least partial hip and rear end coverage, etc.

depending upon the desired length. In one embodiment (not shown), the length of exterior front layer 16 is substantially identical to (for example, just slightly longer than) a length of either of interior front layer 12 and intermediate front layer 14. In view of the above, exterior front layer 16 is one example of means for providing continuous exterior surface substantially covering the intermediate front layer 14.

Interior rear layer 50 is a single panel, for example, of one ply cotton, defining an interior surface 180, which will be positioned immediately adjacent torso 18 during use, and an exterior surface 182 (FIG. 11) opposite interior surface 180 and facing away from torso 18. Interior rear layer 50 extends from a bottom edge 184 thereof upwardly to a top edge 186 of interior rear layer 50, which is substantially linear in one example. Interior rear layer 50 further defines two side edges 188 opposite one another, for example, extending substantially vertically between opposing ends of bottom edge 184 and top edge 186. In one example, a length of interior rear layer 50 as defined between bottom edge 184 and top edge 186 and is substantially equal to a distance between lower end 114 of underarm edge 68 and bottom edge 64 of interior front layer 12.

Exterior rear layer 52 is formed as a single panel, for example, of one ply cotton, defining an interior surface 200, which will be positioned immediately adjacent interior rear layer 50 and a lower portion of torso 18 during use, and an exterior surface 202 opposite interior surface 200 and facing away from torso 18. Exterior rear layer 52 defines and extends from a bottom edge 204 upwardly to a top edge 206 thereof, which is substantially linear in one example. Exterior rear layer 52 further defines two side edges 208 opposite one another, for example, extending substantially vertically between opposing ends of bottom edge 204 and top edge 206. In one example, a length of exterior rear layer 52 as defined between bottom edge 204 and top edge 206 and is substantially equal to a distance between lower end 154 of underarm edge 148 and bottom edge 144 of exterior front layer 16.

Garment 10 includes additional finishes to further complement the aesthetic and functional features of garment 10 and to prevent fraying of edges thereof. In one example, garment 10 includes binding 222 of any suitable form, for example, of fold over elastic, sized to extend along underarm edge 148 and along top edge 206 of exterior rear layer 52.

One example of a method of assembling garment 10 is described below with primary reference to FIG. 10. While one example sequence of assembling and sewing components of garment 10 together is described below, other such sequences/orders are also contemplated and will be apparent to those of skill in the art upon reading this application. In one embodiment, interior front layer 12 is assembled with interior rear layer 50 such that interior surface 60 of interior front layer 12 faces interior surface 180 of internal rear layer 50. More specifically, each side edge 72 of interior front layer 12 is sewn to a different side edge 188 of interior rear layer 50 along a length thereof between lower end 74 of underarm edge 68 of interior front layer 12 and top edge 186 of interior rear layer 50 to bottom edges 64 and 184 of interior front layer 12 and interior rear layer 50, respectively. As such, interior front layer 12 and interior rear layer 50 collectively define an interior portion of garment 10 configured to wrap around torso 18 of a wearer covering breasts 20 of the wearer. Upon assembly, bottom edges 64 and 184 collectively define a circular or oblong bottom edge of an interior tube portion of garment 10.

Figure 12:
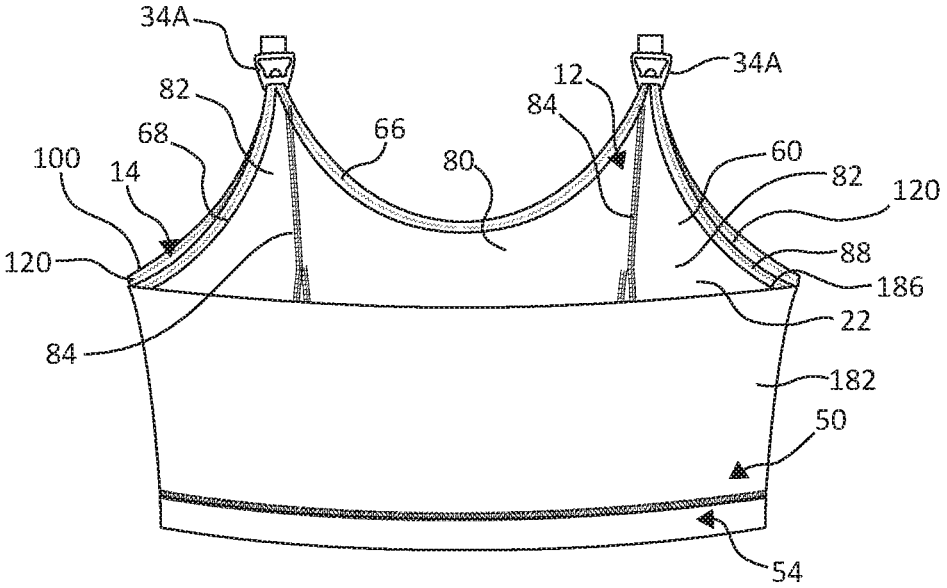
FIG. 12 is a rear view illustration of a partially constructed portion of the nursing garment of FIG. 1, according to one embodiment of the present invention.

Intermediate front layer 14 and elastic band 54 are each simultaneously coupled with interior front layer 12 and interior rear layer 50, in one example. For instance, intermediate front layer 14 is positioned on interior front layer 12 such that interior surface 100 of intermediate front layer 14 is adjacent exterior surface 62 of interior front layer 12 and at least bottom edges 64 and 104 of interior front layer 12 and intermediate front layer 14, respectively, are aligned with, for example, abut, one another along a substantial entirety of their length. Elastic band 54 is a circular piece of elastic, for example, an elongated piece of elastic sewn end to end to form a circle. A top edge of elastic band 54 is positioned adjacent to bottom edges 64 and 104 of interior front layer 12 and intermediate front layer 14 along a front half thereof and adjacent bottom edge 184 of interior rear layer 50 along a back half thereof. Accordingly, top edge 220 of elastic band 54 is sewn to each of bottom edges 64, 104, and 184 resulting in the interior construction illustrated in FIGS. 11 and 12. When so formed, elastic band 54 is configured to hold garment 10 in place around torso 18 just below breasts 20. As illustrated in FIG. 12 upon construction, neckline edge 66 and binding 88 thereon extend above neckline edge 106 and binding 128, thereby, reducing the amount of material over a chest area of a wearer just above breasts 20 to present a smoother overall appearance to garment 10 following construction.

Exterior front layer 16 is coupled with exterior rear layer 52 by aligning bottom edge 144 and side edges 152 of exterior front layer 16 with corresponding bottom edge 204 and side edges 208 of exterior rear layer 52. Accordingly, exterior front layer 16 and exterior rear layer 52 collectively form an exterior tube construction. A hem is added along bottom edges 144 and 204, in one example. Subsequently, an exterior tube portion formed by exterior front layer 16 and exterior rear layer 52 is placed over the interior tube portion in a manner aligning underarm edge 148 of exterior front layer 16 with underarm edge 108 of intermediate front layer 14 and aligning top edge 186 of interior rear layer 50 with top edge 206 of exterior rear layer 52. In one embodiment, a binding 222, for example, foldover elastic, is positioned to extend from a first end 224 at one of top flanges or platforms 164 of exterior front layer 16, down and along first coterminous underarm edges 148 and 108 of exterior front layer 16 and intermediate front layer 14, respectively, along coterminous top edges 186 and 204 of interior rear layer 50 and exterior rear layer 52, and up and along opposite or second coterminous underarm edges 148 and 108 of exterior front layer 16 and intermediate front layer 14 to a second end 226 of binding 222 at an opposite top platform 164. In this manner, a continuously finished edge is presented along the underarms and back of garment 10.

In one embodiment, clips 34, more particularly, a second clip portion 34B, such as a female portion of clip 34, are coupled to top platforms 164 and 124 by placing top platforms 164 and 124 of exterior front layer 16 and intermediate front layer 14, respectively, on top of one another, threading top platforms 164 and 124 through a slit in clip portion 24B, folding top platforms 164 and 124 over an arm of clip portion 34B and securing top platforms 164 and 124 to themselves. Straps 26 each include a first end 90 coupled to one of clip portions 34A and a second end 92 coupled to a rear portion of binding 222 folded over top edges 186 and 206. Straps 26 may be formed of any suitable material and may or may not be adjustable. In one embodiment, straps 26 are self-fabric straps such that garment 10 has a suitable appearance to be worn as either an undergarment or outer clothing. Finally, second clip portions 34B are each selectively mated with a corresponding one of first clip portions 34A to hold tops of intermediate front layer 14 and exterior front layer 16 in place adjacent straps 26 during periods of normal wear.

Figure 5:
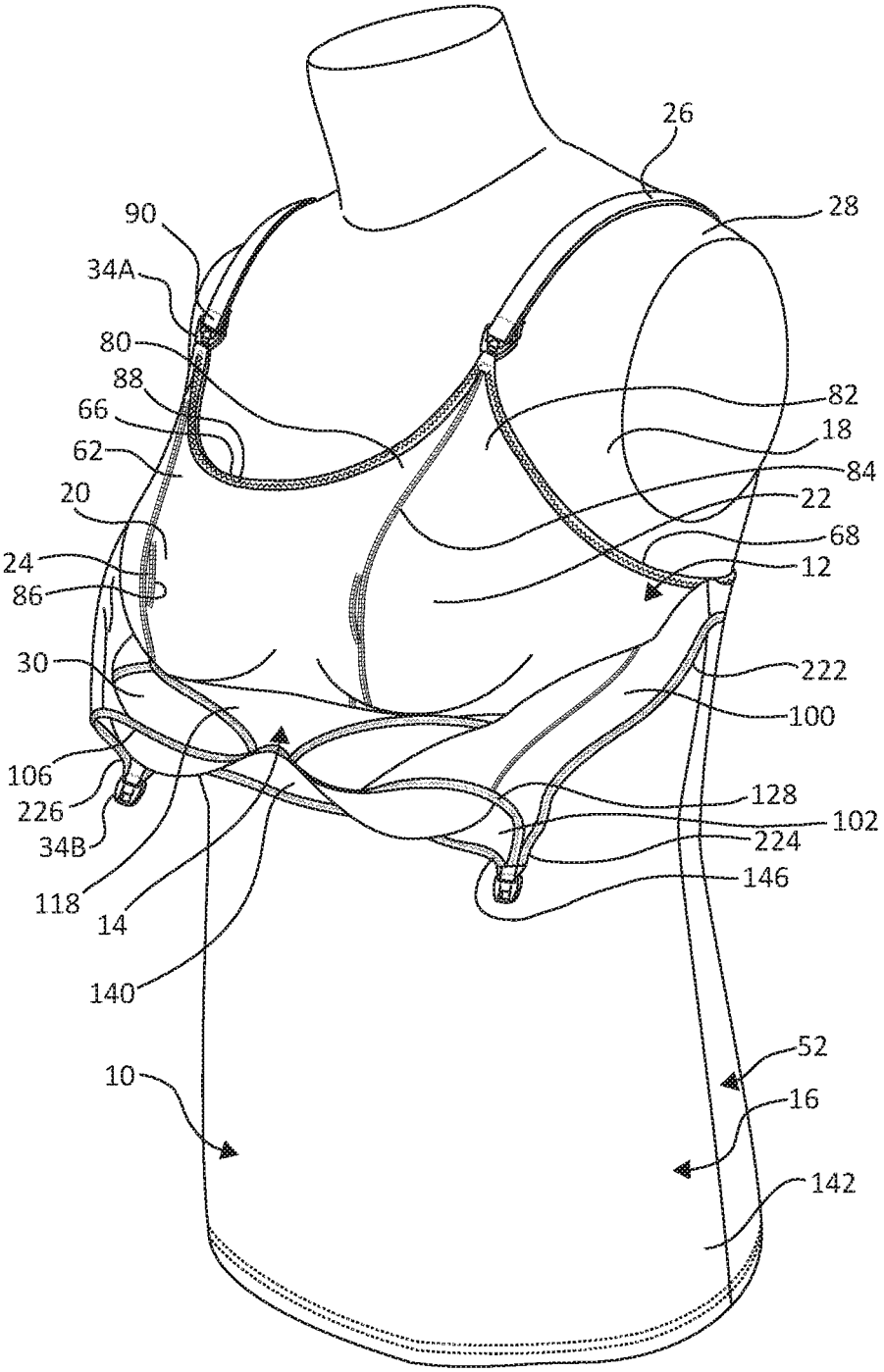
FIG. 5 is a front perspective view illustration of a nursing garment in a nursing configuration, according to one embodiment of the present invention.
Figure 6:
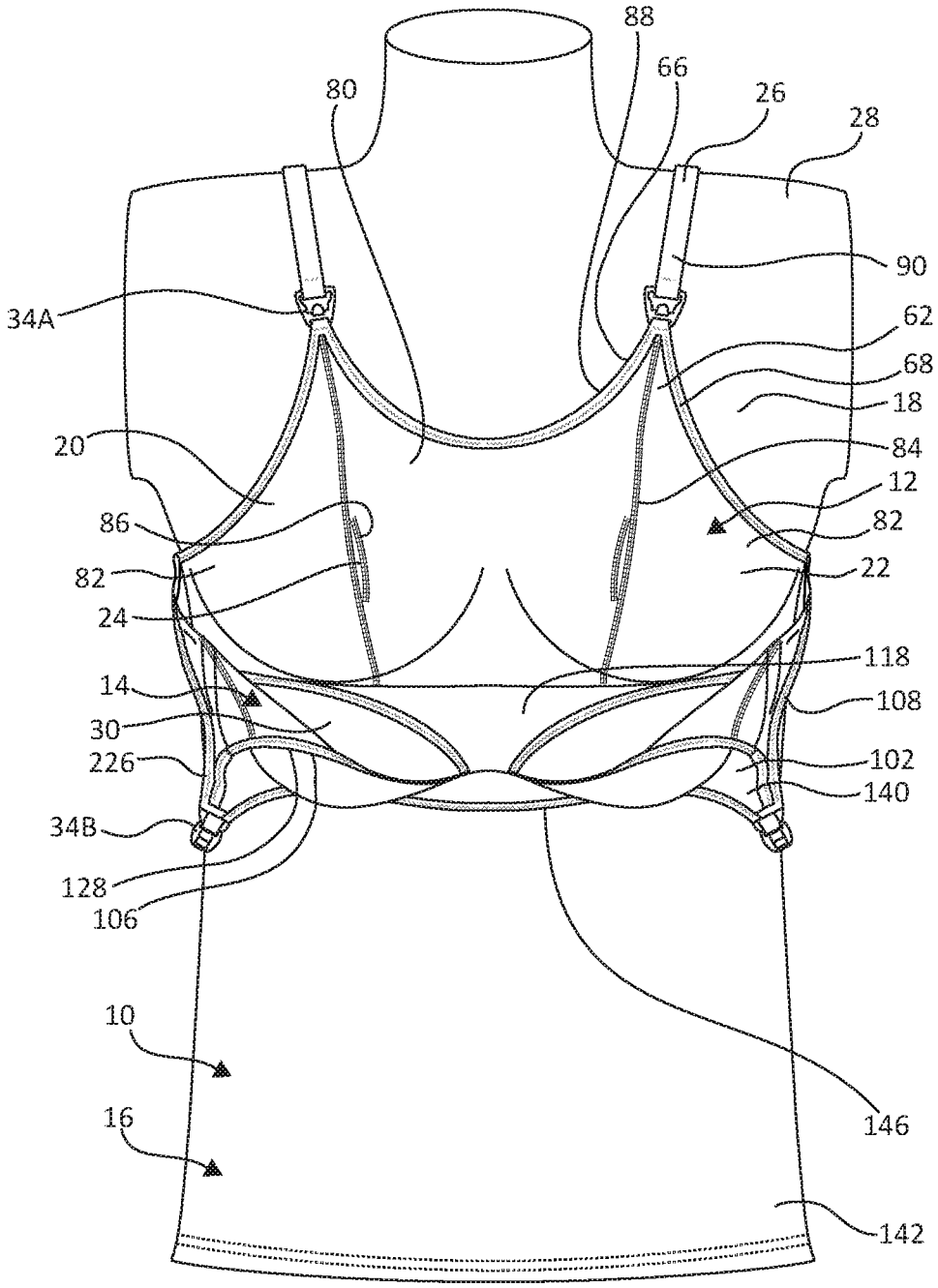
FIG. 6 is a front view illustration of the nursing garment of FIG. 5 in the nursing configuration, according to one embodiment of the present invention.
Figure 7:
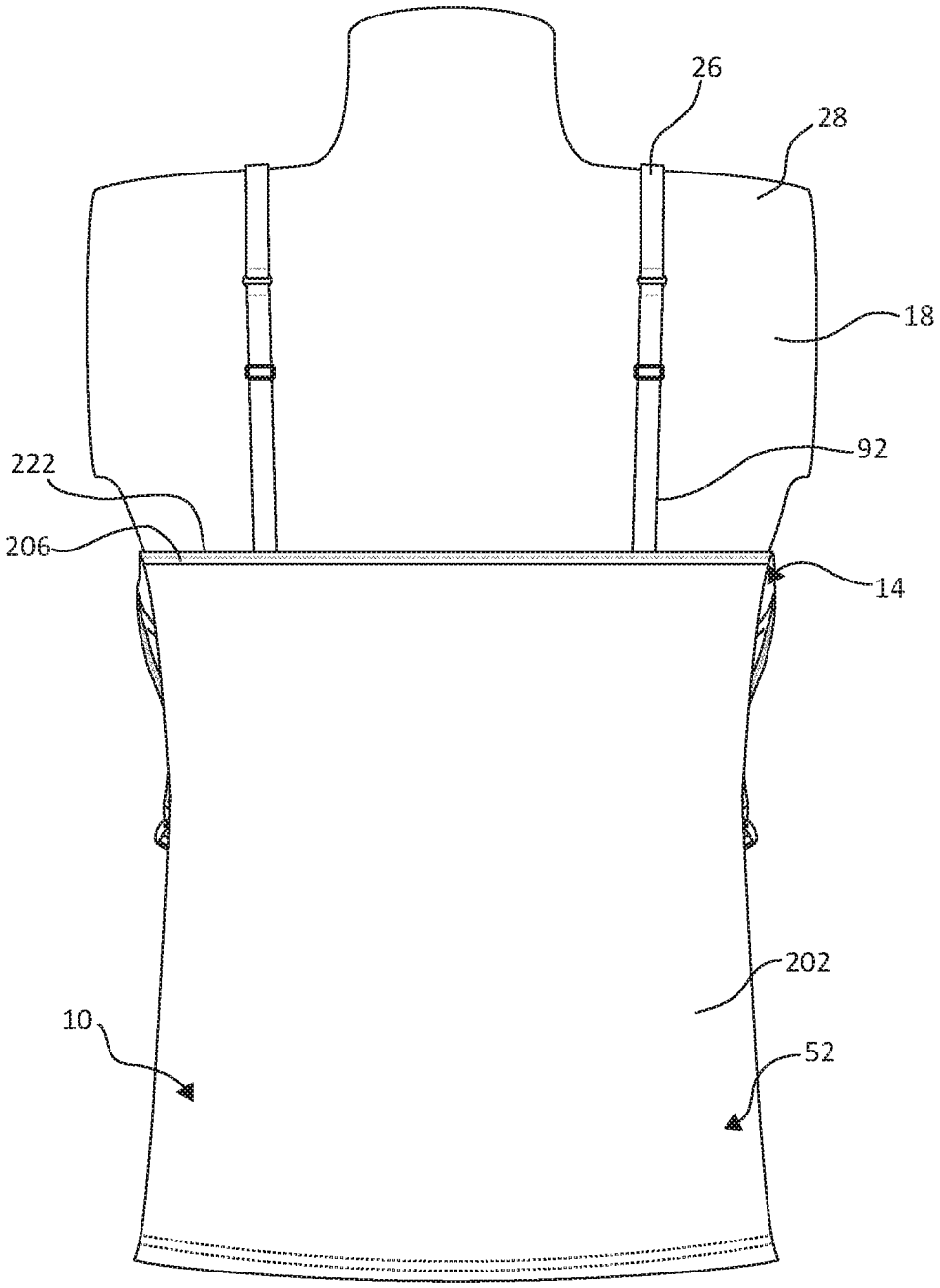
FIG. 7 is a rear view illustration of the nursing garment of FIG. 5 in the nursing configuration, according to one embodiment of the present invention.
Figure 8:
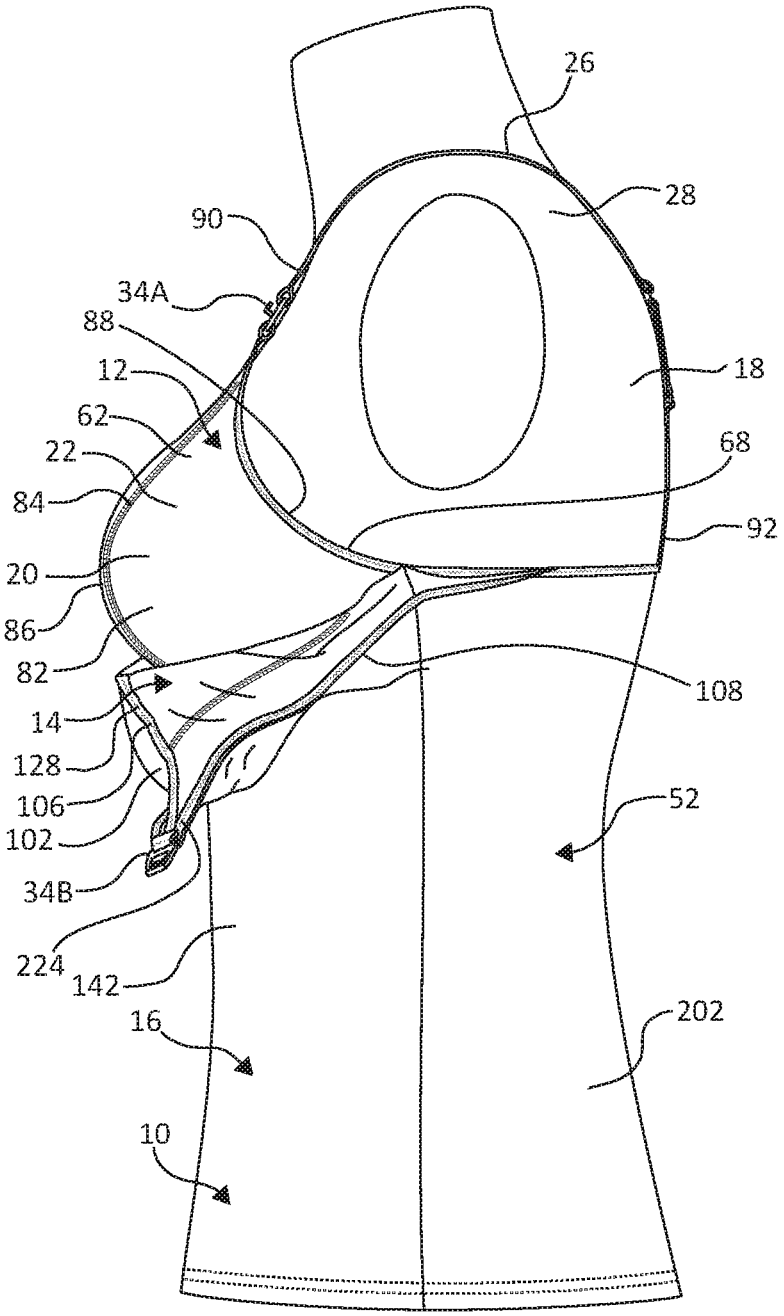
FIG. 8 is a right side view illustration of the nursing garment of FIG. 5 in the nursing configuration, according to one embodiment of the present invention.
Figure 13:
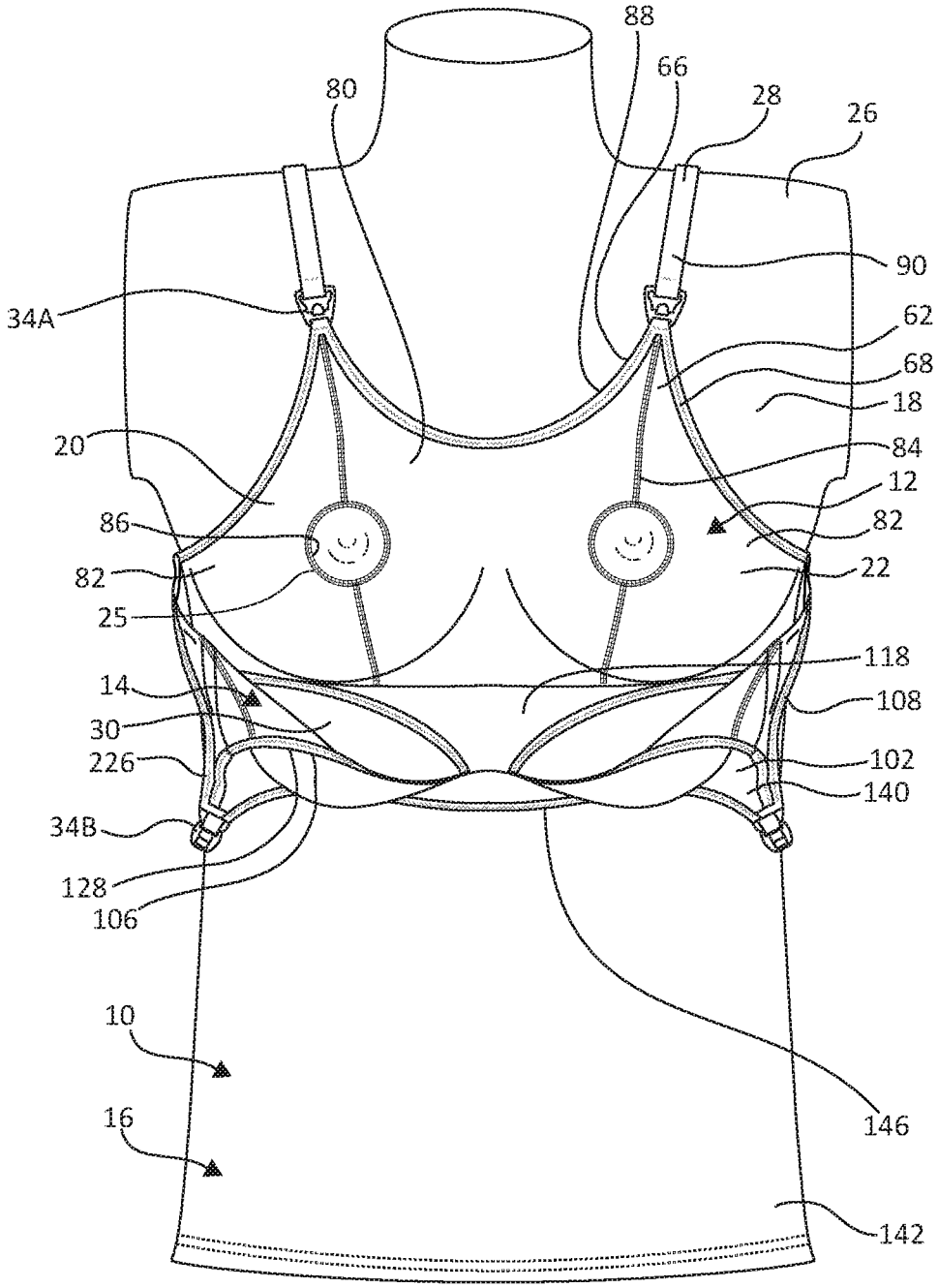
FIG. 13 is a front view illustration of a nursing garment in the nursing configuration, according to one embodiment of the present invention.

Additionally referring to FIGS. 1 and 5, for example, when garment 10 is worn, straps 26 are placed over the woman's shoulders 28 and garment 10 extends downwardly over torso 18. Elastic band 54 is positioned under breasts 20 while exterior front layer 16 and exterior rear layer 52 extend downwardly beyond elastic band to cover a remainder of torso 18. In one embodiment (not shown), exterior front layer 16 and exterior rear layer 52 may terminate near and/or be sewn together with top edge 220 of elastic band 54 instead of covering a remainder of torso 18 as illustrated. The external appearance of garment 10 is of a smooth camisole or tank top. As such, garment 10 can be worn as a smoothing undergarment under many different varieties of tops or, if desired, may be worn alone. When a woman wishes to nurse, either directly with an infant or indirectly by expressing milk, one or both of second clip portions 34B are uncoupled with corresponding first clip portions 34A. Once clips 34 are released, exterior front layer 16 and intermediate front layer 14 are both folded down together due to their common coupling with second clip portion 34B and along underarm edges 108 and 148 revealing openings 24 in interior front layer 12. Depending upon the size of opening 24, from this nursing position, as illustrated in FIGS. 5-9, the wearer can nurse an infant directly, as long as her nipple can be accessed via opening 24, or express milk using shields 36 via opening 24. In one embodiment, openings 24 are sized to generally remain open during all configurations of using garment 10. In another embodiment, openings 24 are slits or are otherwise formed such that openings 24 substantially lay flat and closed during normal wear configurations as shown in FIGS. 1-4. In one embodiment, larger openings 25 replace openings 24 as illustrated in FIG. 13. Openings 24 or 25 are sized to have an open diameter of less than three and a half inches, for example, less than two and a half inches, such that while milk transfer cylinder 40 can fit and extend therethrough, a majority of, for example, substantially all of, shield 36 is covered, thereby, tightly holding shield 36 to breast 20 to maintain the necessary suction for expressing milk from breasts 20. If opening 24 or 25 is large enough to provide for direct breastfeeding, the small size of openings 24 and 25 also provides the woman with increased modesty during direct breastfeeding as compared with the prior art, which bares substantially all of the breast for direct nursing.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A nursing garment configured to be worn by a wearer having breasts, the nursing garment comprising:

an interior front layer adapted to be positioned immediately adjacent the wearer during use of the nursing garment, the interior front layer including soft cups for supporting the breasts of the wearer, wherein each of the soft cups defines an opening through the interior front layer providing access to a different one of the breasts of the wearer;

an intermediate front layer including two padded cups, the intermediate front layer being positioned immediately adjacent the interior front layer, the intermediate front layer defining an intermediate front layer neckline edge and intermediate front layer underarm edges extending away from opposing ends of the intermediate front layer neckline edge, wherein the two padded cups of the intermediate front layer overlie the soft cups of the interior front layer such that each of the two padded cups covers a different one of the openings of the interior front layer; and an exterior front layer extending over the intermediate front layer opposite the interior front layer, the exterior front layer substantially covering the intermediate front layer, wherein:

the exterior front layer defines exterior front layer underarm edges each sewn to a different one of the intermediate front layer underarm edges, to permit nursing, the intermediate front layer and the exterior front layer collectively fold down away from the interior front layer permitting access to one or more of the breasts of the wearer via one or more of the openings of the interior front layer, the interior front layer defines an interior front layer bottom edge and an interior front layer neckline edge opposite the interior front layer bottom edge; and a first clip portion coupled to the interior front layer at an end of the interior front layer neckline edge; and a second clip portion coupled to the intermediate front layer at an end of the intermediate front layer neckline edge and the exterior front layer, wherein the second clip portion is adjacent to one of each of the intermediate front layer underarm edges and the exterior front layer underarm edges, and the second clip portion selectively couples with the first clip portion when the exterior front layer overlays an entirety of both of the interior front layer and the intermediate front layer.

2. The nursing garment of claim 1, wherein the exterior front layer underarm edges are each sewn to the different one of the intermediate front layer underarm edges along a substantial entirety of a length of a corresponding one of the exterior front layer underarm edges.

3. The nursing garment of claim 1, wherein the intermediate front layer includes opposing intermediate front layer side edges extending downwardly from the intermediate front layer underarm edges, and the intermediate front layer extends continuously between the opposing intermediate front layer side edges in a manner defining the two padded cups between the opposing intermediate front layer side edges.

4. The nursing garment of claim 3, further comprising:

an interior rear layer having opposing interior rear layer side edges; and an exterior rear layer having opposing exterior rear layer side edges;

wherein:

the interior front layer includes opposing interior front layer side edges, the exterior front layer includes opposing exterior front layer side edges, and the opposing interior rear layer side edges and the opposing exterior rear layer side edges are each secured to a different one of the opposing interior front layer side edges, a different one of the opposing intermediate front layer side edges, and a different one of the opposing exterior front layer side edges.

5. The nursing garment of claim 4, wherein the opposing interior rear layer side edges and the opposing exterior rear layer side edges are each secured to differing ones of the opposing interior front layer side edges, the opposing intermediate front layer side edges, and the opposing exterior front layer side edges via sewing.

6. The nursing garment of claim 1, wherein:

the intermediate front layer defines an intermediate front layer bottom edge, and the intermediate front layer bottom edge is coextensive with and coupled to the interior front layer bottom edge.

7. The nursing garment of claim 6, wherein:

the intermediate front layer neckline edge is opposite the intermediate front layer bottom edge;

the exterior front layer defines an exterior front layer neckline edge extending between the exterior front layer underarm edges; and the intermediate front layer neckline edge extends free relative to the interior front layer neckline edge and the exterior front layer neckline edge.

8. The nursing garment of claim 6, further comprising an elastic band sewn to and extending along each of the interior front layer bottom edge and the intermediate front layer bottom edge in a manner at least partially coupling the interior front layer to the intermediate front layer, wherein the elastic band is configured to extend below the breasts and around a torso of the wearer.

9. The nursing garment of claim 1, wherein the intermediate front layer is characterized by an absence of any apertures formed therethrough.

10. The nursing garment of claim 1, wherein:

the interior front layer defines an interior front layer neckline edge and an interior front layer bottom edge, the interior front layer continuously extends between the interior front layer neckline edge and the interior front layer bottom edge other than the opening defined by each of the soft cups, and the interior front layer neckline edge extends entirely separately from the intermediate front layer neckline edge.

11. The nursing garment of claim 1, wherein each of the two padded cups are preformed with a convex outer profile.

12. A nursing garment configured to be worn by a wearer having breasts, the nursing garment comprising:

an interior front layer adapted to be positioned immediately adjacent the wearer during use of the nursing garment, the interior front layer including soft cups for supporting the breasts of the wearer, wherein each of the soft cups defines an opening through the interior front layer providing access to a different one of the breasts of the wearer;

an intermediate front layer including two padded cups, the intermediate front layer being positioned immediately adjacent the interior front layer, the intermediate front layer defining an intermediate front layer neckline edge and intermediate front layer underarm edges extending away from opposing ends of the intermediate front layer neckline edge, wherein the two padded cups of the intermediate front layer overlie the soft cups of the interior front layer such that each of the two padded cups covers a different one of the openings of the interior front layer;

an exterior front layer extending over the intermediate front layer opposite the interior front layer, the exterior front layer substantially covering the intermediate front layer, wherein:

the exterior front layer defines exterior front layer underarm edges each sewn to a different one of the intermediate front layer underarm edges, to permit nursing, the intermediate front layer and the exterior front layer collectively fold down away from the interior front layer permitting access to one or more of the breasts of the wearer via one or more of the openings of the interior front layer, the intermediate front layer defines an intermediate front layer bottom edge, the interior front layer defines an interior front layer bottom edge and an interior front layer neckline edge opposite the interior front layer bottom edge, and the intermediate front layer bottom edge is coextensive with and coupled to the interior front layer bottom edge; and a first clip portion coupled to the interior front layer at an end of the interior front layer neckline edge, and a second clip portion coupled to the intermediate front layer at an end of the intermediate front layer neckline edge and the exterior front layer, wherein the second clip portion is adjacent to one of each of the intermediate front layer underarm edges and the exterior front layer underarm edges, and the second clip portion selectively couples with the first clip portion when the exterior front layer overlays an entirety of both of the interior front layer and the intermediate front layer.

13. The nursing garment of claim 12, wherein the each of the intermediate front layer neckline edge and the intermediate front layer bottom edge are continuously formed as they extend across a width of the intermediate front layer defined between opposing side edges of the intermediate front layer.

14. A nursing garment configured to be worn by a wearer having breasts, the nursing garment comprising:

an interior front layer adapted to be positioned immediately adjacent the wearer during use of the nursing garment, the interior front layer including soft cups for supporting the breasts of the wearer, wherein each of the soft cups defines an opening through the interior front layer providing access to a different one of the breasts of the wearer;

an intermediate front layer including two padded cups, the intermediate front layer being positioned immediately adjacent the interior front layer, the intermediate front layer defining an intermediate front layer neckline edge and intermediate front layer underarm edges extending away from opposing ends of the intermediate front layer neckline edge, wherein the two padded cups of the intermediate front layer overlie the soft cups of the interior front layer such that each of the two padded cups covers a different one of the openings of the interior front layer; and an exterior front layer extending over the intermediate front layer opposite the interior front layer, the exterior front layer substantially covering the intermediate front layer, wherein the exterior front layer defines exterior front layer underarm edges each sewn to a different one of the intermediate front layer underarm edges;

wherein:

to permit nursing, the intermediate front layer and the exterior front layer collectively fold down away from the interior front layer permitting access to one or more of the breasts of the wearer via one or more of the openings of the interior front layer;

the intermediate front layer includes opposing intermediate front layer side edges each separately sewn to the interior front layer, the intermediate front layer includes a cradle extending to each of and between the opposing intermediate front layer side edges, and the cradle extends below and is coupled each of the two padded cups.

15. The nursing garment of claim 14, wherein:

the intermediate front layer includes two underarm panels, and each of the two underarm panels is coupled separately coupled to a different one of the two padded cups and to a different one of the exterior front layer underarm edges.

16. The nursing garment of claim 15, wherein the intermediate front layer includes a binding extending along an entirety of the intermediate front layer neckline edge and sewn to each of the two padded cups and the two underarm panels.

17. A method of supporting a nursing apparatus on a breast of a wearer, the method comprising:

positioning a nursing garment over a torso and over breasts of the wearer, the nursing garment comprising:

an interior front layer adapted to be positioned immediately adjacent the wearer during use of the nursing garment, the interior front layer including soft cups for supporting the breasts of the wearer, wherein each of the soft cups defines an opening through the interior front layer providing access to a different one of the breasts of the wearer, an intermediate front layer including two padded cups, the intermediate front layer being positioned immediately adjacent the interior front layer, the intermediate front layer defining an intermediate front layer neckline edge and intermediate front layer underarm edges extending away from opposing ends of the intermediate front layer neckline edge, wherein the two padded cups of the intermediate front layer overlie the soft cups of the interior front layer such that each of the two padded cups covers a different one of the openings of the interior front layer, and an exterior front layer extending over the intermediate front layer opposite the interior front layer, the exterior front layer substantially covering the intermediate front layer, wherein the exterior front layer defines exterior front layer underarm edges each sewn to a different one of the intermediate front layer underarm edges;

the interior front layer defines an interior front layer bottom edge and an interior front layer neckline edge opposite the interior front layer bottom edge; and a first clip portion coupled to the interior front layer at an end of the interior front layer neckline edge; and a second clip portion coupled to the intermediate front layer at an end of the intermediate front layer neckline edge and the exterior front layer, wherein the second clip portion is adjacent to one of each of the intermediate front layer underarm edges and the exterior front layer underarm edges, and the second clip portion selectively couples with the first clip portion when the exterior front layer overlays an entirety of both of the interior front layer and the intermediate front layer; and collectively folding down the intermediate front layer and the exterior front layer away from the interior front layer permitting access to one or more of the breasts of the wearer via one or more of the openings of the interior front layer.

18. The method of claim 17, further comprising:

inserting a breast shield coupled with a pump apparatus between one of the breasts and the interior front layer of the nursing garment including positioning a milk transfer cylinder extending from the breast shield to extend through the opening in the interior front layer such that the breast shield is maintained in sufficient contact with the one of the breasts by the interior front layer to allow for sufficient suction for expressing milk without use of the hands of the wearer.

19. The method of claim 18, further comprising:

expressing milk from the one of the breasts through the milk transfer cylinder and the interior front layer and into a container readily separable from a remainder of the pump apparatus.

20. The method of claim 18, wherein collectively folding down the intermediate front layer and the exterior front layer includes maintaining the breasts in a substantially covered manner via the interior front layer.

* * * * *